US007832890B2

(12) United States Patent
Jesse

(10) Patent No.: US 7,832,890 B2
(45) Date of Patent: Nov. 16, 2010

(54) FACIAL TISSUE CONTAINER WITH INTEGRATED NIGHT LIGHT

(76) Inventor: Billin Jesse, P.O. Box 269, Chocorua, NH (US) 03817

( * ) Notice: Subject to any disclaimer, the term of this patent is extended or adjusted under 35 U.S.C. 154(b) by 5 days.

(21) Appl. No.: 11/863,340

(22) Filed: Sep. 28, 2007

(65) Prior Publication Data

US 2009/0084693 A1 Apr. 2, 2009

(51) Int. Cl.
*F21V 33/00* (2006.01)

(52) U.S. Cl. ..... 362/154; 362/156; 362/234; 362/253; 362/644; 206/233; 206/457

(58) Field of Classification Search ..... 362/154–156, 362/234, 253, 641–644, 800; 206/233, 389, 206/457; 221/305
See application file for complete search history.

(56) References Cited

U.S. PATENT DOCUMENTS 4,736,280 A * 4/1988 Simidian ..... 362/253
5,437,766 A 8/1995 Phan
5,624,025 A * 4/1997 Hixon ..... 362/253
D425,346 S 5/2000 Thompson
D453,084 S 1/2002 Lange
6,521,240 B1 2/2003 Minerath
6,910,600 B2 6/2005 Keberlein
6,926,398 B2 8/2005 Ando
2007/0262088 A1 * 11/2007 Nanda ..... 221/305

* cited by examiner

*Primary Examiner*—Stephen F Husar
(74) *Attorney, Agent, or Firm*—Thomas T. Aquilla

(57) ABSTRACT

A facial tissue container having an internal light source includes a window opening and frame for receiving and retaining the light source, a sealed sanitary barrier or cover over the window opening, and a powered LED unit, including a printed circuit board operably connected to multiple LEDs, a switch mechanism for operating the LEDs, and a power supply, a retaining mechanism for reversibly attaching the powered LEDs to the window frame. The light source also preferably also includes a dimmer switch mechanism for controlling LED brightness, and a switch mechanism for filtering the LEDs to emit colored light, and for changing colors based on predetermined patterns.

23 Claims, 6 Drawing Sheets

PRIOR ART

4A

4B

4C

FACIAL TISSUE CONTAINER WITH INTEGRATED NIGHT LIGHT

BACKGROUND OF THE INVENTION

1. Field of the Invention

The invention pertains to the field of illumination. More particularly, the invention pertains to apparatus for illuminating a container of facial tissues from the inside of the container.

2. Description of Related Art

Facial tissue products are primarily utilitarian in nature. The purposes for these products are obvious, and the technical advancements in the toilet paper, paper towel and facial tissue products arts have been numerous over the years. Recent technical advancements in the facial tissue arts have been made in the areas of increased softness (e.g., quilting, chemical softeners, moisturizing lotions, etc.), added strength and reduced moisture penetration. For example, U.S. Pat. No. 6,521,240, assigned to Kimberly-Clark Worldwide, Inc., discloses a facial tissue composition for sequestration of nasal secretion skin irritants, and U.S. Pat. No. 5,437,766, assigned to The Procter & Gamble Company, discloses a multi-ply facial tissue paper product comprising biodegradable chemical softening compositions and binder materials.

In addition to making such technical advancements in the various papers, technical and aesthetic advancements also have been made in the packaging of facial tissues. For example, U.S. Pat. No. 6,910,600 discloses an in-line windowed facial tissue carton having more continuity of packaging and fewer glued sides. In this manner, any graphics on the package can continue unimpeded, without being aligned and glued, along the sides and up around the top to the window opening of the container. The improved container provides cleaner, uninterrupted graphics printed upon the container, resulting in a more dramatic and effective visual effect. Also advantageously, the tissue container can be built with fewer construction materials because there are fewer flaps.

Paper manufacturers also have developed a wide variety of non-utilitarian packaging improvements for facial tissues, offering an array of colors and designs inked, printed or embossed on the paper (and the containers as well) to provide a more pleasing appearance. Going one step further, U.S. Pat. No. 6,926,308 discloses toilet paper, paper towel and facial tissue products that have information placed, through printing or embossing, on the toilet paper, paper towels and facial tissues. The information can include advertisements, coupons, prizes (such as stickers and crossword puzzles), games or other promotional materials.

Also known are various decorative covers or "custom" containers intended for facial tissues, which usually either fit over the original facial tissue container or are designed for the original container to fit inside (see, e.g., U.S. Pat. Nos. D453,084 and D425,346).

One ongoing problem is that typical facial tissue containers, while perhaps being decorative or colorful, generally are poorly visible or not at all visible in the dark. However, it is often desired that the facial tissues be visible at any time of the day or night, often at any time of the year, and particularly if one has a cold or the flu.

As a solution to the foregoing problem, night lights or guide lights sometimes have been used in an effort to improve the night-time visibility of household items, such as facial tissues or the rubbish bin. However, in many cases, a typical night light is placed in a wall outlet near the floor, not near the surface of a night stand or table, where facial tissues are normally located. Furthermore, in some cases, a lamp or night light may produce excessive light, or may be otherwise undesirable. Glowing paint also may be used to mark the location of the facial tissue dispenser or the container itself, but this does not provide sufficient light to illuminate the tissues or the surrounding area.

Thus, there is a need in the art for the development of a lighted facial tissue container that provides direct but discreet lighting to the facial tissue dispenser, such that it may easily be seen at night, without producing unwanted indoor light pollution.

SUMMARY OF THE INVENTION

The apparatus according to the invention provides a container of facial tissues illuminated from the inside of the container. The invention provides a lighted facial tissue container that provides direct but discreet illumination of the facial tissues, such that the tissues, dispenser and surrounding area may easily be seen at night, without producing unwanted indoor light pollution.

Briefly stated, the invention provides a facial tissue illumination device, comprising a facial tissue container including a window opening and frame for receiving and retaining a light source, and a removable powered LED unit, including a printed circuit board operably connected to one or more LEDs, on/off switch means for operating said LEDs, and a power supply. Preferably, there is a sealed sanitary barrier or cover over the window opening, to protect the tissues. The removable powered LED unit includes a retaining mechanism for reversibly attaching the powered LEDs to the window frame. The light source optionally includes a dimmer switch mechanism for controlling LED brightness, and a switch mechanism for filtering the LEDs to emit colored light, and for changing colors based on predetermined patterns.

In the preferred embodiment, the power cord and LED device are of a unitary construction and can be snapped into and removed from the window frame member of any tissue box that has been adapted to receive the LED unit. In this manner, one can discard an empty tissue box and retain the light for use with a new box of tissues. Replacement tissue boxes adapted for receiving the LED unit are then provided.

In an alternative embodiment, the invention provides a tissue container adapted for receiving an internal light source, wherein the tissue container includes a window opening and frame for receiving and retaining a mounted light source. One embodiment comprises a perforated removable window panel on the tissue box for receiving a frame for retaining the light source, the frame being fitted to a window opening created by removal of the perforated removable window panel.

The invention provides a reliable facial tissue container illumination device, providing discreet lighting directly to the facial tissue dispenser, such that it easily can be seen at night, without producing unwanted indoor light pollution.

These and other features and advantages will become readily apparent from the following detailed description, which should be read in conjunction with the accompanying drawing figures.

BRIEF DESCRIPTION OF THE DRAWING

The drawing figures are not necessarily to scale, with the emphasis instead placed upon the principles of the present invention. Additionally, each of the embodiments depicted are but one of a number of arrangements possible utilizing the fundamental concepts of the present invention. The drawings are briefly described as follows.

DETAILED DESCRIPTION OF THE INVENTION

The following description relates to certain preferred embodiments of an apparatus for illuminating a container of facial tissues from the inside of the container. Numerous variations and modifications, other than those specifically indicated, will be readily apparent to those of sufficient skill in the art. In addition, certain terms are used throughout the discussion in order to provide a convenient frame of reference with regard to the accompanying drawings, such as "front", "back", "inside", "outside", and the like. Such terms are not intended to be specifically limiting of the invention, except where so indicated in the claims.

The invention provides a container of facial tissues illuminated from the inside of the container. The invention provides a lighted facial tissue container that provides direct but discreet lighting to the facial tissues, as well as providing light to the surrounding area. Thus, the invention serves the dual purpose of lighting the facial tissues and providing a night light. In the preferred embodiment, the facial tissue container includes a window opening and frame for receiving and retaining the light source, and a removable powered LED unit, including a printed circuit board operably connected to one or more LEDs, on/off switch means for operating said LEDs, and a power supply. The removable powered LED unit includes a retaining mechanism for reversibly attaching the powered LEDs to the window frame. Numerous various optional configurations are contemplated. For example, the powered LED unit optionally is battery powered.

Figure 1:
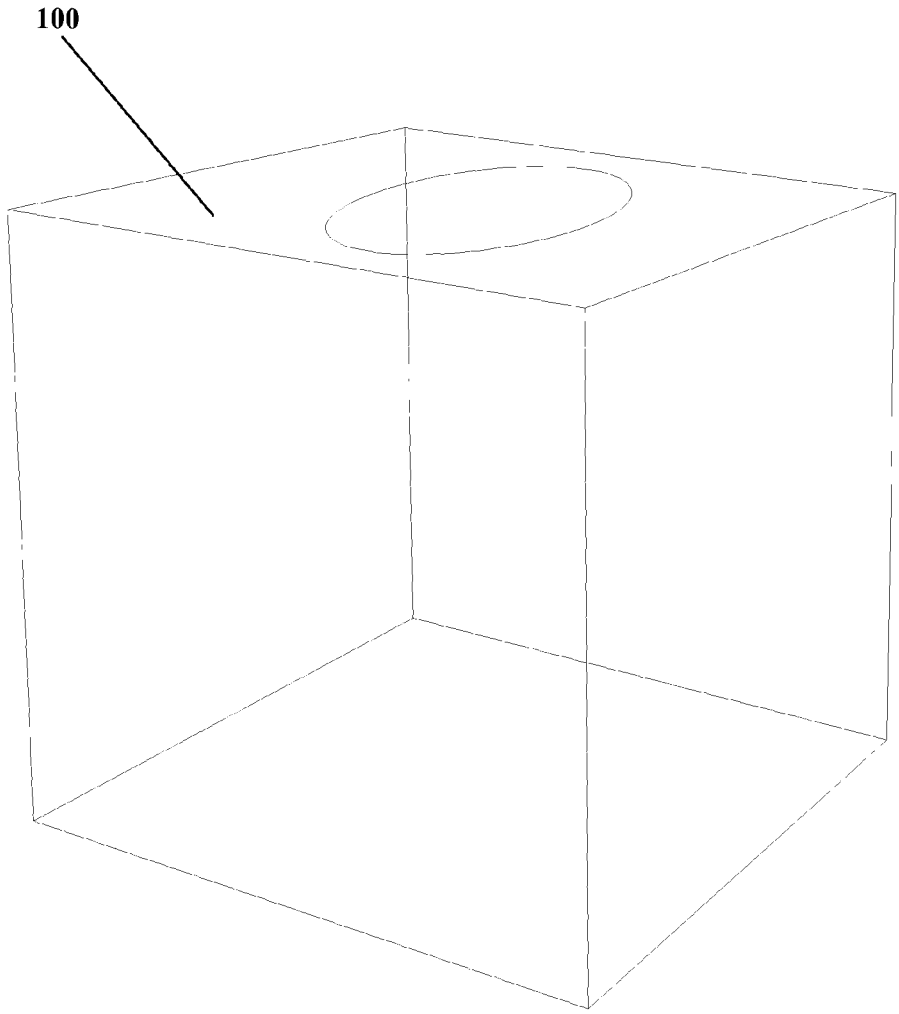
FIG. 1 shows a typical facial tissue container of the prior art.
Figure 2:
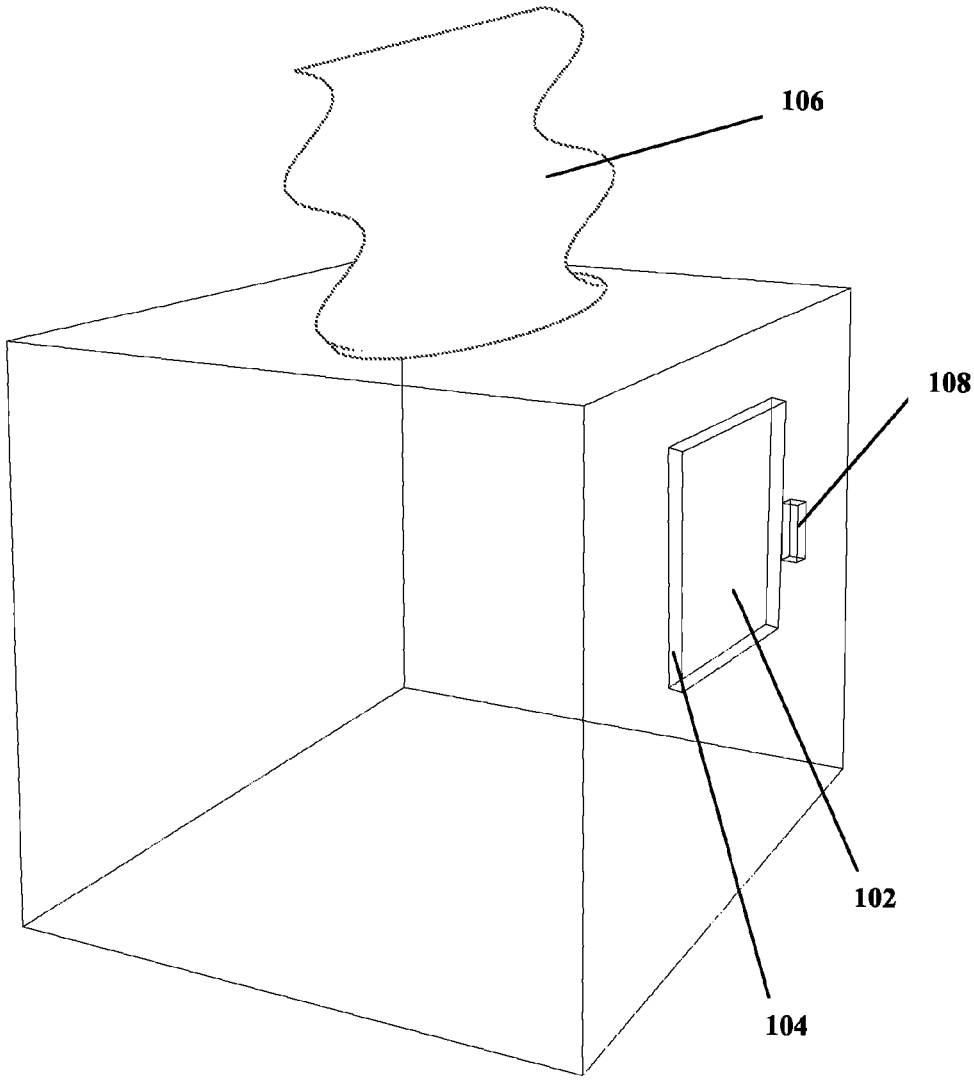
FIG. 2 shows a facial tissue container adapted for receiving a light source in accordance with an embodiment of the present invention.
Figure 5:
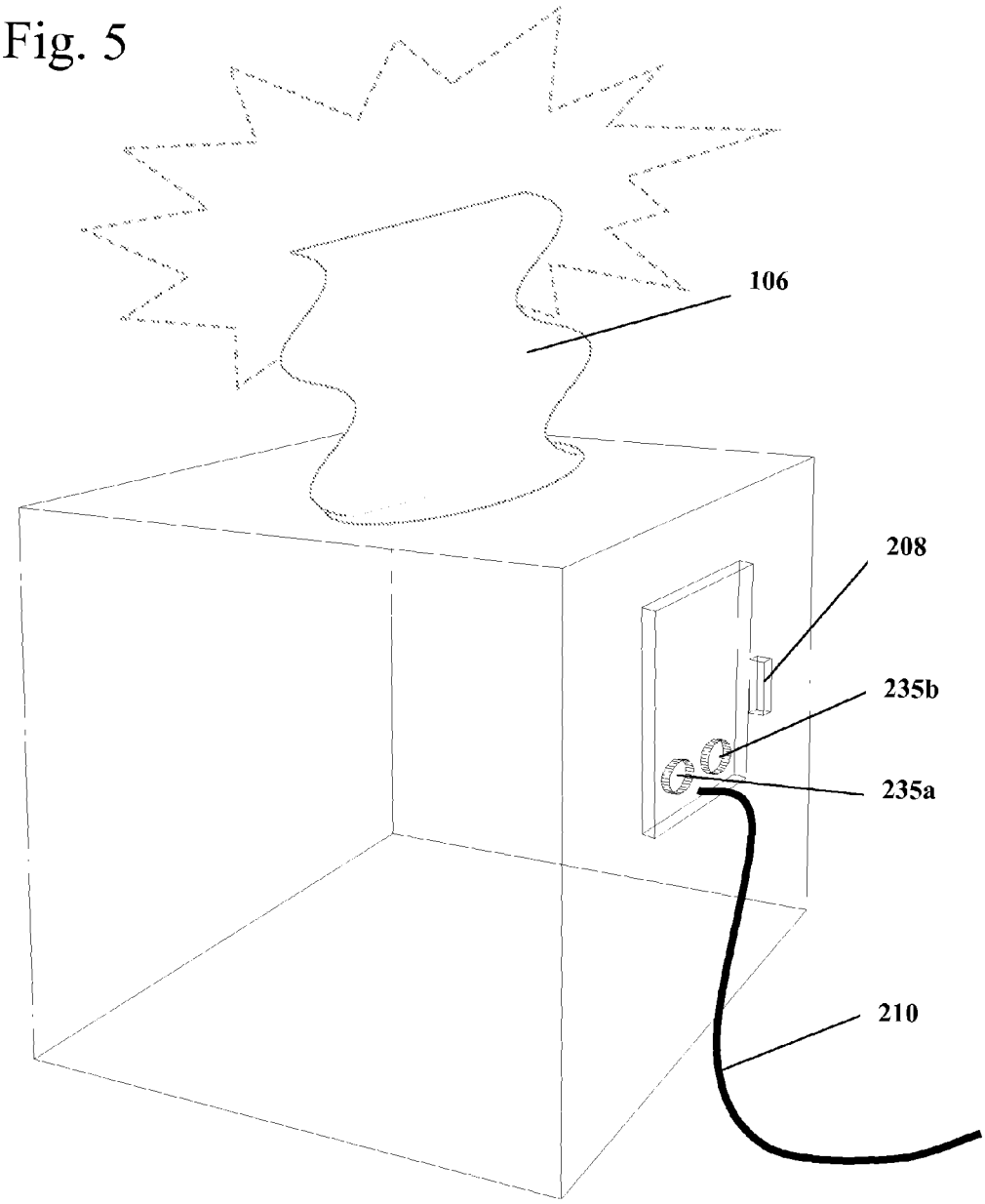
FIG. 5 shows a perspective view of a facial tissue container and removable powered LED unit in accordance with an embodiment of the present invention.

Referring now to FIG. 2, a facial tissue container adapted to receive and retain a light source for illuminating a facial tissue 106 in accordance with the invention is shown. Facial tissue container 100 is adapted for receiving a light source by creating a window opening 102 in the tissue container and affixing a frame member 104 for supporting the light source. The frame member preferably should be located at the rear side of the facial tissue container. Frame member 104 includes retaining means 108 for holding the LED circuit board in place. In the embodiment shown, retaining means 108 is a simple spring-loaded clip (see 208). The LED circuit board and LEDs should be arranged within the frame member such that the light source is located near the top of the facial tissue container, so that the tissues will not block the light. Furthermore, the light should be located near the top opening of the facial tissue container, so that the next tissue protruding from the container is well lit by the LEDs. It is contemplated that in normal use, facial tissue containers will be manufactured with frame member 104 factory-installed, such that the containers are already adapted to receive the powered LED unit. However, in an alternative embodiment, replacement facial tissue containers include a perforated or scored removable window panel (not shown) for receiving frame member 104. Upon removal of the removable window panel, frame member 104 is fitted into the window opening. Preferably, a sealed sanitary barrier (not shown) covers the window opening to protect the facial tissues and keep the contents clean. The sanitary barrier should be transparent, so that the light can easily enter the container. FIG. 5 shows the facial tissue 106 being illuminated by the light source.

Figure 3:
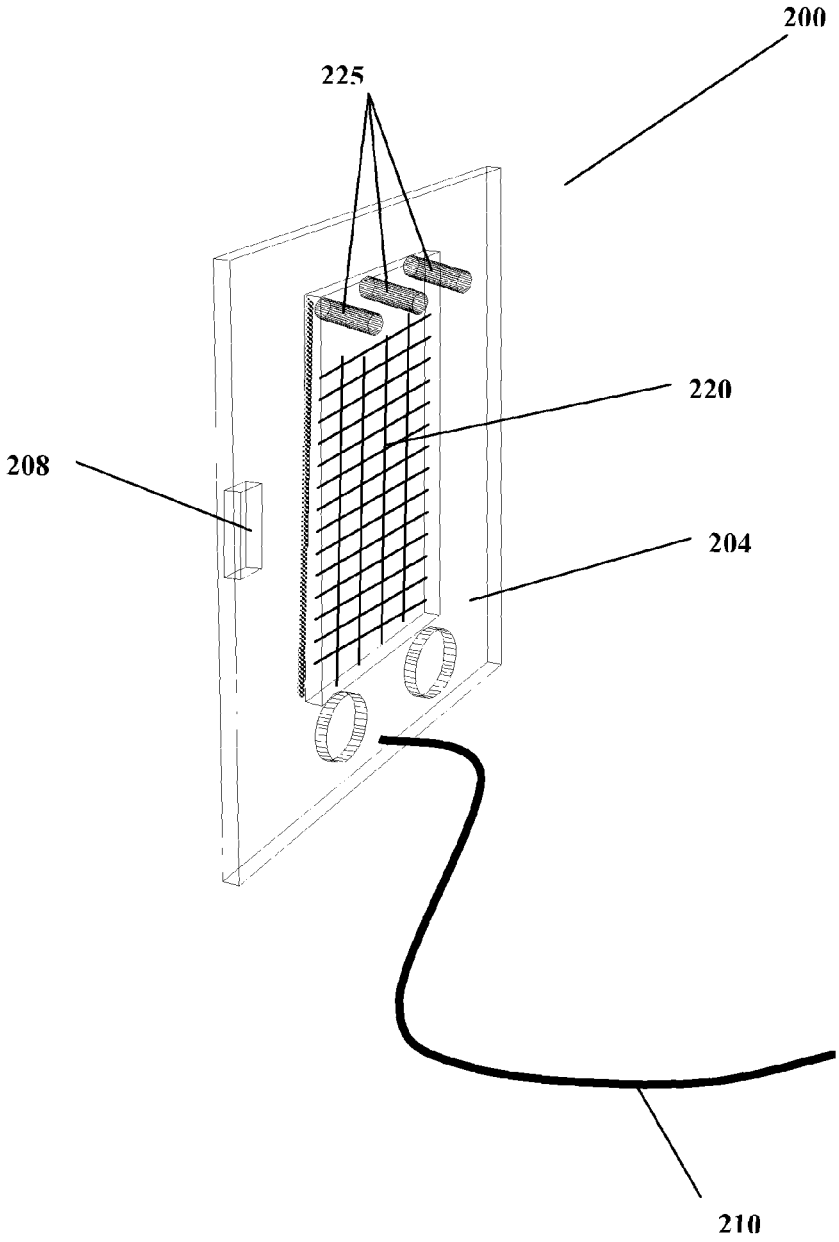
FIG. 3 shows a removable powered LED unit in accordance with an embodiment of the present invention.
Figure 4:
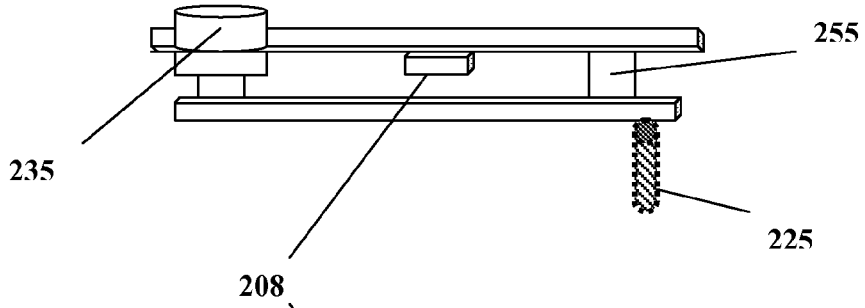
FIGS. 4A-4C show multiple views of a removable powered LED unit in accordance with an embodiment of the present invention.
Figure 4:
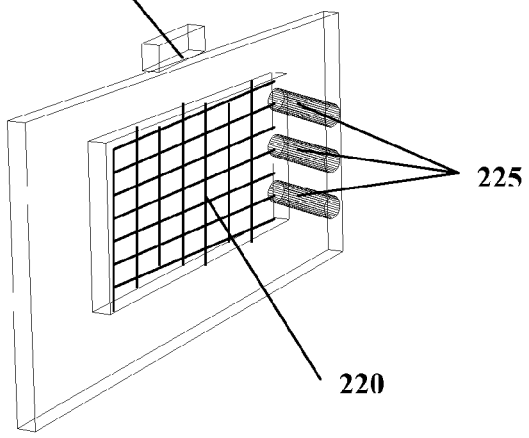
Figure 4:
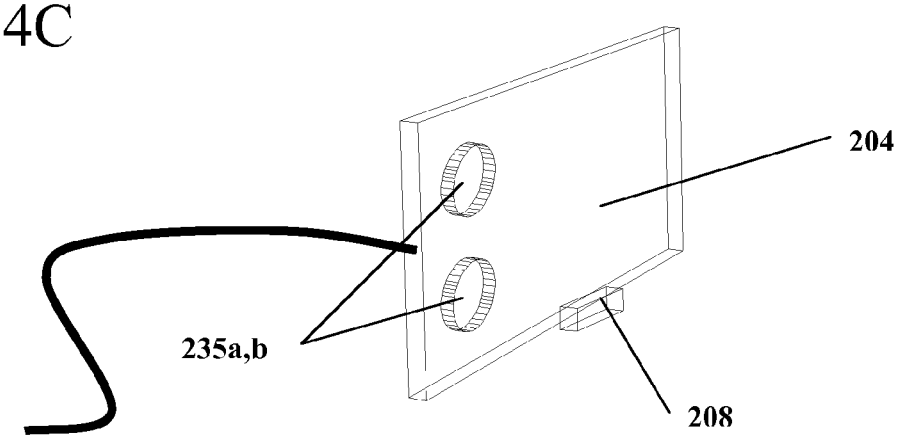

Referring now to FIGS. 3 and 4, apparatus for illuminating a facial tissue container in accordance with the invention is shown. Printed circuit board 220 is operably connected to LEDs 225 and powered by power supply 210. The complete powered LED unit is a is available off the shelf (indirectly), and was obtained from a "Glade PlugIns" brand "LightShow" air freshener. The printed circuit board is a Z.I.C. model ROX r1.0 ASIC C71317 v3.0 051031, as shown on the surface of the printed circuit board. The complete powered LED unit, with attached power cord, was simply extracted from the air freshener and affixed to cover plate 204 as described below.

The printed circuit board 220 is mounted to cover plate 204 with spacers 255 providing the required clearance. Switches 235*a* and 235*b* also are mounted to pass through the cover plate and are operatively connected to the circuit board. Cover plate 204 includes a retaining clip 208, which holds the circuit board and LEDs securely in the corresponding retaining means 108 of the window frame member 104. The powered LED unit is removable and reusable. Once the facial tissues in a container have all been used, the LED unit is removed and the container can be discarded as usual. The LED unit is then snapped into a replacement container.

In the preferred embodiment, switches 235*a* and 235*b* control a multitude of functions programmed into the LED unit. For example, the LEDs can be turned on and off, brightness can be adjusted, and the LEDs can be set to change colors at varying speeds, or to continuously display one color.

According to its contemplated use, the invention provides an increased level of comfort for children, by combining a night light feature with facial tissue dispenser. This can be very soothing, when a child has a cold or other respiratory illness. By providing printed or embossed tissues in the container, the resulting images can be lighted, producing an additional special effect.

It is further contemplated that, in some cases, it may be desirable to affix the night light to an external cover of said facial tissue container, such as, for example, the many various decorative covers or "custom" containers intended for facial tissues, which usually either fit over the original facial tissue container or are designed for the original container to fit inside. In such cases, the LED unit can be affixed to the cover or the cover may be adapted with a frame member for receiving the light source.

Figure 6:
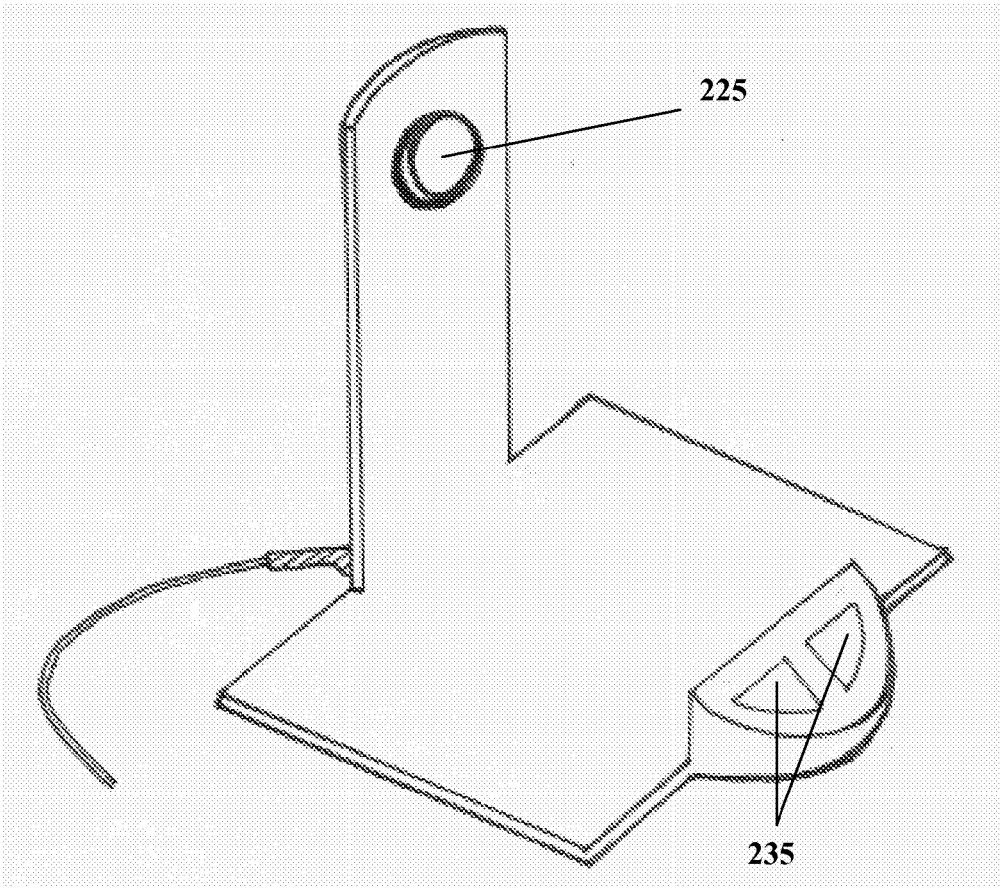
FIG. 6 shows an alternative embodiment for providing light to a facial tissue, in accordance with an embodiment of the present invention.

Referring now to FIG. 6, an alternative embodiment of the invention is shown, comprising a separate stand for providing light to the facial tissue dispenser. This embodiment is suitable for use with any standard facial tissue container, and does not require making any adaptations or changes to the package. By creating a small hole in the facial tissue container, the light enters from the stand into the container.

The invention thus provides the advantage of providing discreet lighting directly to the facial tissues and the dispenser, such that it easily can be seen at night, without producing unwanted indoor light pollution. The invention further serves a decorative purpose and provides comforting security for a sick child. The lighted tissues are quite striking in appearance and the light passing through the tissue provides an effect similar to that of a lamp shade. Thus, the invention provides both decorative and utilitarian benefits.

It is to be understood that the architectural and operational embodiments described herein are exemplary of a plurality of possible arrangements to provide the same (or equivalent) general features, characteristics, and general system operation. Therefore, while there have been described the currently preferred embodiments of the present invention, those skilled in the art will recognize that other and further modifications may be made, without departing from the spirit of the present invention, and it is intended to claim all modifications and variations as fall within the scope of the appended claims. Accordingly, it must further be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A facial tissue container comprising a light source attached to a window opening in an external wall of said facial tissue container and enclosed within said container, such that said light source illuminates the interior of said container from within, thereby directly illuminating said facial tissue from within said container.

2. The apparatus of claim 1, wherein said light source is attached to said window opening through an external cover of said facial tissue container.

3. The apparatus of claim 1, wherein said window opening includes a frame member for receiving and retaining said light source.

4. The apparatus of claim 3, further comprising a sealed sanitary barrier or cover over said window opening.

5. The apparatus of claim 2, wherein said light source comprises one or more Light Emitting Diodes (LEDs).

6. The apparatus of claim 3, wherein said light source comprises one or more Light Emitting Diodes (LEDs).

7. The apparatus of claim 6, wherein said light source comprises:

a powered LED unit, including a printed circuit board operably connected to said one or more LEDs, on/off switch means for operating said LEDs, and a power supply.

8. The apparatus of claim 7, wherein said powered LED unit further comprises retaining means for reversibly attaching said powered LEDs to said frame member for receiving and retaining said light source.

9. The apparatus of claim 7, wherein said powered LED unit further comprises dimmer switch means for controlling LED brightness.

10. The apparatus of claim 7, wherein said powered LED unit further comprises switch means for filtering said LEDs to emit colored light, and means for changing colors based on predetermined patterns.

11. The apparatus of claim 7, further comprising one or more tissues that are embossed or printed with an image.

12. The facial tissue container of claim 1, comprising adaptation means for receiving and retaining said light source within said container.

13. The apparatus of claim 12, wherein said adaptation means comprises a perforated removable window panel for receiving a frame for retaining said light source.

14. The apparatus of claim 13, said frame being fitted to a window opening created by removal of said perforated removable window panel.

15. The apparatus of claim 14, further comprising a sealed sanitary barrier or cover over said window opening.

16. The apparatus of claim 14, wherein said light source comprises one or more Light Emitting Diodes (LEDs).

17. The apparatus of claim 14, wherein said light source comprises:

a powered LED unit, including a printed circuit board operably connected to said one or more LEDs, on/off switch means for operating said LEDs, and a power supply.

18. The apparatus of claim 17, wherein said powered LED unit further comprises retaining means for reversibly attaching said powered LEDs to said frame member for receiving and retaining said light source.

19. The apparatus of claim 17, wherein said powered LED unit further comprises dimmer switch means for controlling LED brightness.

20. The apparatus of claim 17, wherein said powered LED unit further comprises switch means for filtering said LEDs to emit colored light, and means for changing colors based on predetermined patterns.

21. The apparatus of claim 17, further comprising one or more tissues that are embossed or printed with an image.

22. The facial tissue container of claim 1, comprising an internal light source, wherein said tissue container includes:

a) said window opening and a frame member for receiving and retaining said light source;

b) a sealed sanitary barrier or cover over said window opening;

c) wherein said light source comprises a powered LED unit, including a printed circuit board operably connected to one or more LEDs, on/off switch means for operating said LEDs, and a power supply;

d) retaining means for reversibly attaching said powered LEDs to said frame member for receiving and retaining said light source;

e) dimmer switch means for controlling LED brightness; and f) switch means for filtering said LEDs to emit colored light, and means for changing colors based on predetermined patterns.

23. A method for illuminating a facial tissue, comprising the steps of:

a) providing a facial tissue container; and b) attaching a light source to a window opening in an external wall of said facial tissue container, such that said light source illuminates the interior of said container from within, thereby directly illuminating the facial tissue from within said container.

* * * * *